US005465499A

United States Patent [19]

LaPlante

[11] Patent Number: 5,465,499

[45] Date of Patent: Nov. 14, 1995

[54] TOOL FOR INSTALLING SIDING

[76] Inventor: Daniel J. LaPlante, 384 Meadow Rd., Farmington, Conn. 06032

[21] Appl. No.: 293,293

[22] Filed: Aug. 22, 1994

[51] Int. Cl.[6] ..... G01D 21/00

[52] U.S. Cl. ..... 33/647; 52/DIG. 1; 269/904

[58] Field of Search ..... 33/646, 647, 648, 33/649, 411; 81/45; 269/43, 45, 904; 52/749, 105, 547, 548, DIG. 1

[56] References Cited

U.S. PATENT DOCUMENTS

| | | | |
|---|---|---|---|
| 108,010 | 10/1870 | Deyo . | |
| 119,200 | 9/1871 | Tinsley | 33/647 |
| 124,028 | 2/1872 | Bigelow . | |
| 132,159 | 10/1872 | Kropf | 33/646 |
| 159,597 | 2/1875 | Mefford . | |
| 253,816 | 2/1882 | Clark | 33/646 |
| 338,156 | 3/1886 | Johnson . | |
| 372,221 | 10/1887 | Hubbard et al. . | |
| 631,315 | 8/1899 | Meskill | 33/647 |
| 920,941 | 5/1909 | Filkin | 33/648 |
| 1,115,202 | 10/1914 | Ingles | 33/646 |
| 1,598,986 | 9/1926 | Ping | 33/647 |
| 3,792,852 | 2/1974 | Reniker . | |
| 4,155,175 | 5/1979 | Stiles . | |
| 4,654,975 | 4/1987 | Lopez | 33/646 |
| 4,862,669 | 9/1989 | Jacobsen | 33/648 |
| 4,899,459 | 2/1990 | Taggart | 33/646 |
| 4,936,021 | 6/1990 | Flenette et al. | 33/649 |
| 5,370,377 | 12/1994 | Van Der Meer | 33/647 |

*Primary Examiner*—Thomas B. Will
*Attorney, Agent, or Firm*—Hayes & Reinsmith

[57] ABSTRACT

A tool for installing siding on a building wall is disclosed wherein only two formed metal parts are shown which are of utter simplicity and are relatively adjustable one to the other to provide variation in desired exposure to weather of each underlying siding member as determined by the positioning of the parts in assembled relation. A generally J-shaped bracket and an adjustable U-shaped siding support are provided with the support being releasably attached to the bracket with a pair of legs on the support extending through a pair of a series of openings in the bracket. The bracket has a lower hook with a reversely bent lip which may be inserted into wedged engagement between a building wall and an affixed strip of siding for readily securing the tool in position to enable a leg of the support to provide the only assistance required for a single worker to install an overlying strip of siding.

9 Claims, 3 Drawing Sheets

TOOL FOR INSTALLING SIDING

FIELD OF THE INVENTION

This invention generally relates to a tool for use in installing siding to a wall of a building and particularly concerns a tool of this general type which is readily used to enable one worker to completely install siding on a building.

BACKGROUND OF THE INVENTION

Tools for use in installing siding to enable a single worker without any assistance to complete the installation of siding on a building wall are known. Such tools frequently are of relatively expensive construction and have several parts, some of which are moving parts. U.S. Pat. No. 108,010 to Deyo, for example, provides a straight forward approach for hanging clapboard, but Deyo introduces significant additional and undesirable costs into the manufacture of the device by the provision of a tang on which a handle is attached to a metallic strip having indicia formed on the strip with a set screw adjustment which may be secured in an infinitely variable number of positions. While the Deyo device is relatively simple, it yet is relatively expensive to make. There are a variety of other gages of this type such as that illustrated in U.S. Pat. No. 1,598,986 to Ping and U.S. Pat. No. 372,221 to Hubbard, as well as more recent patents involving tools of this general type such as illustrated in U.S. Pat. No. 3,792,852 to Reniker and in Stiles U.S. Pat. No. 4,155,175. The patent to Reniker involves a number of parts which comprise two or more identical units in the form of a hand grip which is operatively connected with bolts and wing nuts to a hanger to provide for proper spacing and application of shingles or shakes on a surface of a building wall. The Stiles patent illustrates a desired step in the direction of simplicity in that it does not require any moving parts. However, the tool itself requires that a spike or nail be used to secure the tool to the building wall to enable the tool to be used for aligning siding strips, and the Sties tool does not have the advantage of being adjustable.

OBJECTS OF THE INVENTION

A principal object of this invention is to provide a new and improved tool of significantly simplified structure which may be quickly and easily manufactured at low cost for reliable use over extended periods of time for accurate installation of siding by a single worker.

Another object of this invention is to provide such a new and improved tool of the type described which does not require any spikes or nails to maintain the tool in place during use but, rather, may be attached without any other means or accessories such as retainers or fasteners.

Yet another object of this invention is to provide such a new and improved tool of the type described which has no moving parts and yet provides ready adjustment for selectively establishing the exposure to weather of the strips of siding installed.

Other objects will be in part obvious and in part pointed out more in detail hereinafter.

SUMMARY OF THE INVENTION

A tool for installing siding on a building wall is disclosed and comprises a J-shaped bracket having a lower hook and a plurality of openings above the hook. An adjustable siding support is releasably attachable to the bracket and has a pair of projections integrally fixed on the support and spaced apart a distance corresponding to the spacing between the openings of the bracket with the projections registrable with a selected pair of openings for fixing the support in a predetermined position above the bracket hook.

A better understanding of this invention will be obtained from the following detailed description and accompanying drawings of an illustrative application of the invention.

DESCRIPTION OF A PREFERRED EMBODIMENT

This invention comprises a tool for use in installing siding, specifically, wooden clapboard and the like, on a building wall. As is well known to those skilled in the art, an upper strip of siding is superimposed in partially lapped relation to a lower strip of siding. The installation of such siding normally requires two or more workers to complete the job unless a suitable tool is provided which enables one to not only align but also attach the siding strips to the building wall without need of an assistant.

Figure 1:
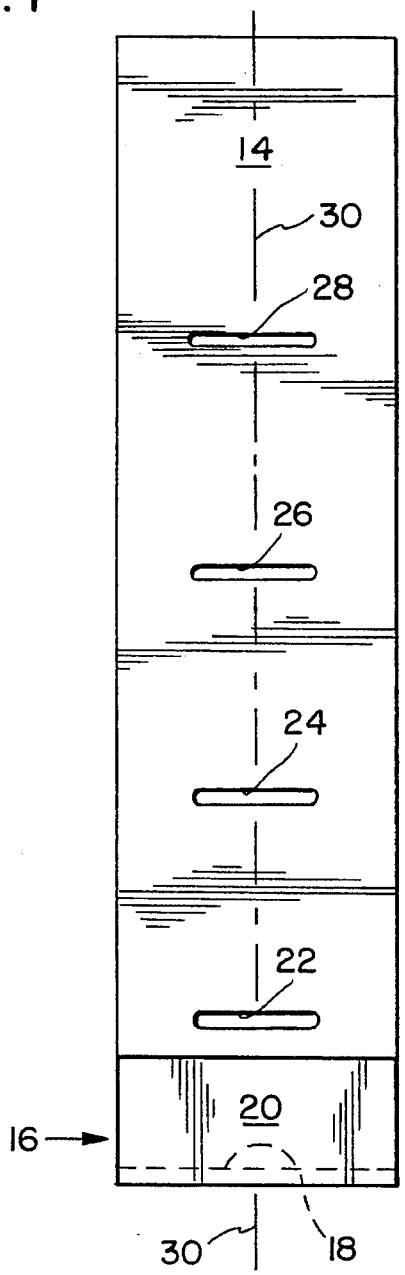
FIG. 1 is a from elevational view of a bracket of a tool of this invention for installing siding.
Figure 2:
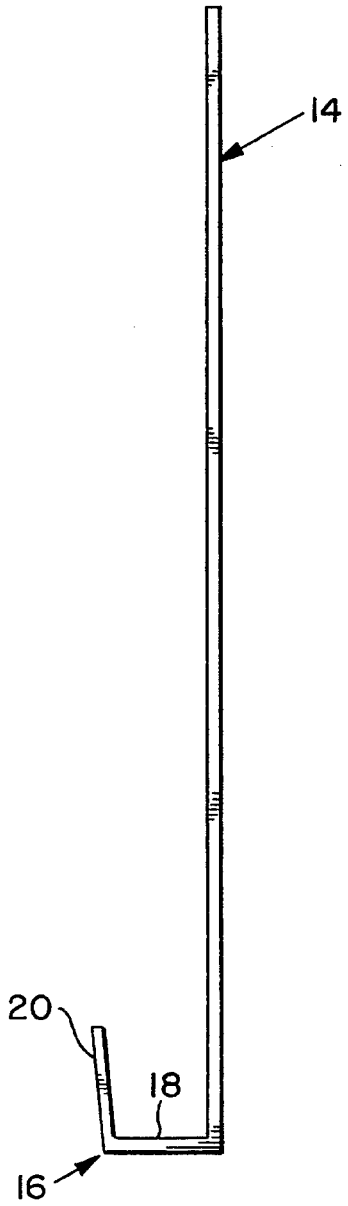
FIG. 2 is a side elevational view of the bracket of FIG. 1.

Referring now to the drawings, a tool generally designated 10 is provided for hanging siding on a building wall 12. Tool 10 has a generally J-shaped bracket 14 formed of strip material. The strip material may be formed of aluminum or any other suitable metal or of a tough durable plastics material formed to a desired shape in accordance with this invention. The J-shaped bracket 14 has a hook 16 at its lower end which (as best seen in FIG. 2) is provided with an outwardly projecting stop 18 and reversely bent lip 20 which in the embodiment illustrated is shown inclined at an approximately 95° angle relative to the projecting stop 18. As illustrated, the J-shaped bracket 14 is a single integral piece. In the specifically illustrated embodiment, bracket 14 has a series of equally spaced openings shown in the form of parallel slots (at 22, 24, 26 and 28) extending perpendicularly to a longitudinal axis 30 of the bracket 14, the slots being longitudinally aligned along the bracket 14 above its hook 16.

To provide an exceptionally fundamental design, the simplicity of which is seemingly incompatible with achieving the variety of highly desirable objects of this invention, an adjustable siding support 32 is disclosed featuring releasable attachment to the bracket 14 for selectively adjusting the extent to which siding is exposed to weather while providing quick and easy application without time wasting efforts in accurately installing siding on a building wall.

Figure 3:
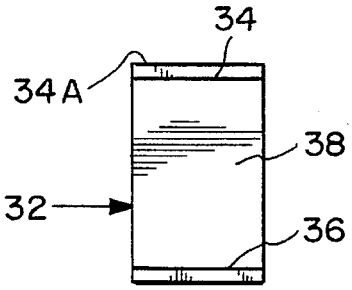
FIG. 3 is a from elevational view of an adjustable siding support of the tool of this invention.
Figure 4:
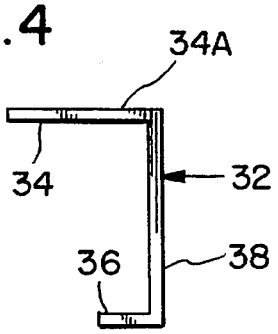
FIG. 4 is a side elevational view of the support of FIG. 3.
Figure 5:
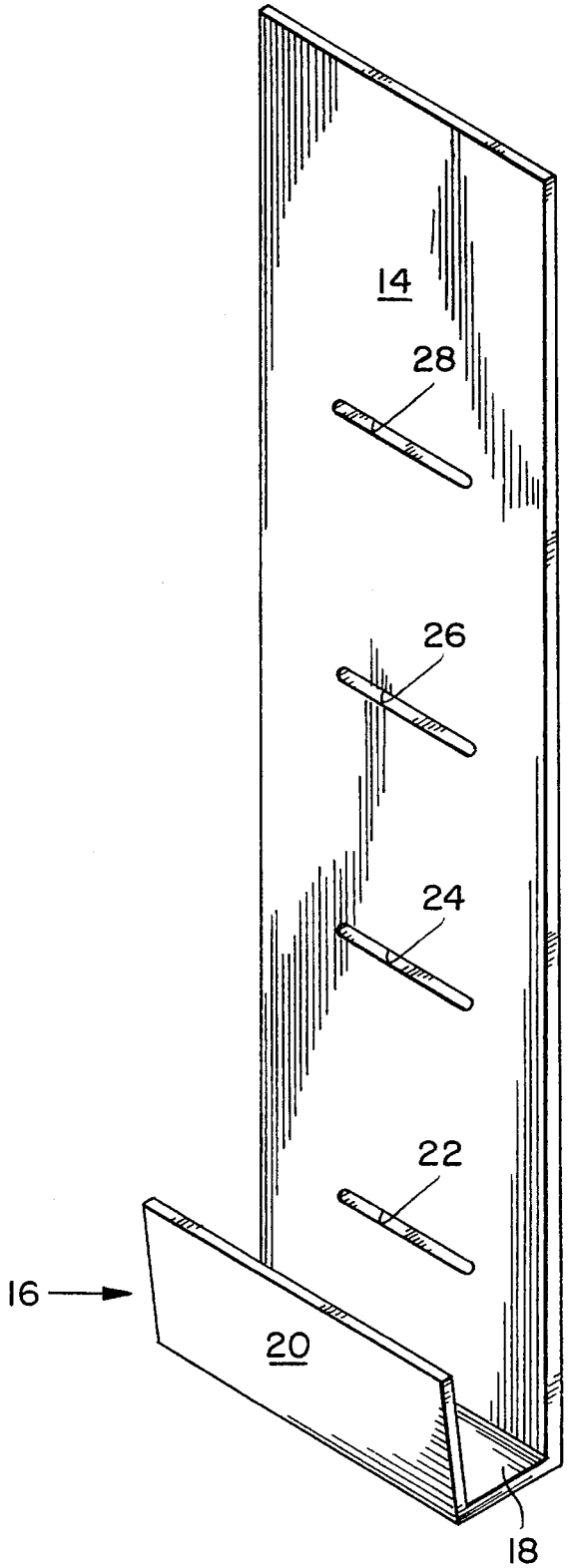
FIG. 5 and FIG. 5A are perspective views of the bracket and support in disassembled relation.
Figure 5A:
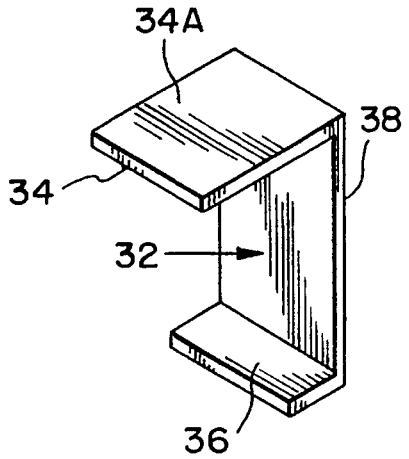

More specifically, the support 32 illustrated in FIGS. 3 and 4 has a pair of projections or legs 34, 36 extending outwardly from opposite ends of a common interconnecting member. The legs 34, 36 are spaced apart a distance which corresponds to the spacing between openings in the J-shaped bracket 14, specifically, between pairs of adjacent openings such as 22, 24 and 24, 26 and 26, 28. The legs 34, 36 as best seen in FIGS. 5 and 5A thus are registrable with any of a selected pair of adjacent openings for fixing the support 32 in a predetermined position above the bracket hook 16 when the bracket 14 is in assembly with the support 32.

In the preferred embodiment, the legs 34, 36 of the adjustable siding support 32 are of different lengths and are shown extending outwardly perpendicularly from member 38 whereby the legs of the support are particularly adapted to extend through adjacent slots of the bracket. To assemble support 32 in relation to the bracket 14 for use in installing siding, both legs 34, 36 of the support 32 are accordingly frictionally engaged and retained by the material of the bracket 14 surrounding its slots with the legs of the support being disposed in overlying relation to the bracket hook 16.

By virtue of the above described structure, it will be noted that the longer leg 34 of the support 32 additionally serves as a seat for an overlying siding strip 40. Thus, when the support 32 is disposed above the bracket hook 16 for supporting the overlying siding ship 40 in parallel lapping relation to an underlying affixed siding ship 42 (FIG. 6), the registration of the legs 34, 36 of the support 32 frictionally engaged within adjacent openings of the bracket 14 determine the extent to which each underlying siding strip such as at 42 is exposed to weather. That is, the openings (22, 24, 26 and 28) of the bracket itself are formed in a predetermined pattern along the bracket 14 and thus provide a variation of exposure to weather of each underlying siding ship 42 which may be selectively established as determined by the positioning of the support 32 on the bracket 14. As an illustration, were the illustrated four slots spaced apart, say, 1.5 inches from one another with the lowermost slot 22 formed, say, 1.0 inches above stop 18 of bracket 14, then the tool 10 may be adjusted to readily provide strips having exposure to weather of from 2.5 inches to 5.5 inches. Exposure to weather of the siding strips corresponds generally to the distance between the stop 18 on the bracket hook 16 and an upper face 34A of the uppermost longer leg 34.

Figure 6:
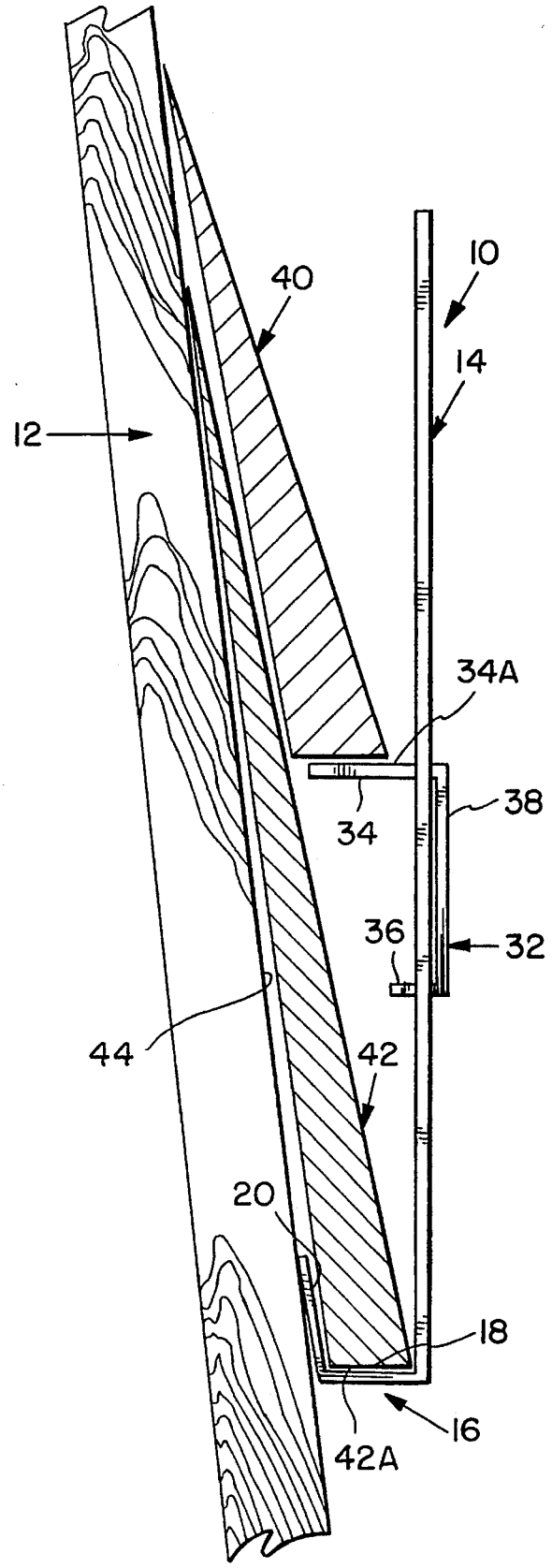
FIG. 6 is a side elevational view of the tool of this invention in assembled relation for use in installing strips of siding on a building wall.

In the use of the tool 10, lowermost strip 42 of siding is first attached to the wall of a building in a conventional manner. Referring to FIG. 6, a building wall is shown having a surface 44 which is to be covered with the siding. Affixed siding member 42 is shown as having been previously attached to the wall surface 44, and the tool 10 of this invention is shown assembled and is illustrated in position as being attached to provide alignment and proper spacing to the next overlying strip 40.

Lip 20 of bracket hook 16 is wedged under a thicker bottom edge 42A of the fixed strip 42 of siding to secure bracket 14 at one end of that siding whereby a free end of overlying strip 40 thus may be supported on a face 34A of support leg 34 while the worker positions and secures an opposite end of that overlying siding strip 40 by a nail, e.g., and works back to the free end maintained by the tool 10 while nailing the siding along longitudinally spaced points as necessary.

More specifically, the tool 10 is simply secured by inserting lip 20 between the building wall surface 44 and the affixed siding strip 42 such that the lip 20 is releasably wedged securely between these members with stop 18 of the J-shaped bracket 14 engaged with a bottom edge of the affixed siding strip 42 to automatically maintain the bracket 14 in position for installing overlying strip 40 of siding without any requirement whatsoever for fasteners, retainers or other accessories securing the siding tool in position. The bracket 14 may be progressively wedged more tightly the closer the worker places the lip 20 to a nail (not shown) holding the fixed length of siding. Thus, the tool 10 may be readily attached. With the adjustable support 32 in assembly with the bracket 14 in a selected pair of adjacent slots to provide a predetermined exposure to weather of the underlying siding strip 42, the overlying siding strip 40 is readily positioned on the support 32 wherein its longer leg 34 is shown normally disposed above its other leg 36. Thus, the longer leg 34 serves additionally as a seat providing support for the overlying siding strip 40. Once that overlying siding strip 40 has been installed, it then becomes the pattern upon which the next overlying siding strip is aligned and attached with the aid of the tool 10 of this invention as previously described.

By virtue of the above described structure, the tool of this invention will be seen to be designed with subtle simplicity to permit accomplishment of highly desired but infrequently achieved functions in a tool having no moving parts and only two separate components readily capable of providing variation in exposure to weather of the strips of siding being installed.

Although this invention has been illustrated and described with respect to an exemplary embodiment thereof, additions may be made without departing from the spirit and scope of the invention.

I claim:

1. A tool for installing siding strips on a building wall and comprising a generally J-shaped bracket, the bracket having
- a hook at its lower end and
- a plurality of equally spaced openings longitudinally aligned along the bracket above its hook, and an adjustable siding support releasably attachable to the bracket, the support having
- a pair of projections integrally fixed thereon and spaced apart a distance corresponding to the spacing between bracket openings,
- the projections being registrable with a selected pair of bracket openings for fixing the support on the bracket in assembled relation in a predetermined position above the bracket hook, whereby the support maintains an overlying siding strip during installation in overlapping relation to an underlying strip affixed to a building wall with the extent of overlap established by registration of the projections of the support within a selected pair of bracket openings.

2. The tool of claim 1 wherein the bracket and the support each are formed of strip material.

3. The tool of claim 1 wherein the bracket openings are formed in a predetermined pattern along the bracket establishing a preselected exposure to weather of each underlying siding strip as determined by the positioning of the support within the openings of the bracket.

4. The tool of claim 1 wherein the bracket hook is defined by an outwardly projecting stop and a reversibly bent lip, the lip being insertable between a building wall and a previously installed siding strip affixed to the wall for releasably wedging the lip therebetween with the stop engaged with a bottom portion of the affixed siding strip to automatically secure the bracket in position for installing the overlying siding strip with an established uniform overlapping of the underlying affixed siding strip and providing it with a predetermined exposure to weather.

5. The tool of claim 4 wherein the exposure to weather of the siding strip corresponds generally to the distance between the stop on the bracket hook and an upper face of the support defined by one of its projections.

6. The tool of claim 1 wherein the pair of projections on the support are spaced apart a distance corresponding to the spacing between adjacent bracket openings and are registrable with a selected pair of adjacent bracket openings for fixing the bracket in assembled relation in a predetermined position above the bracket hook.

7. The tool of claim 2 wherein the bracket openings are parallel slots extending perpendicularly to a longitudinal axis of the bracket, and wherein the support is a generally U-shaped member having parallel legs extending outwardly from a common interconnecting member, the legs defining the projections of the support and being spaced apart a distance corresponding to spacing between bracket slots to permit the support to be releasably attached in assembly with the bracket in a preselected adjusted position thereon.

8. The tool of claim 7 wherein the legs of the support are of different lengths and extend perpendicularly from the common interconnecting member, the support being attachable in assembly with the bracket, the legs of the support extending through bracket slots with a longer leg of the support disposed above its other leg, both legs of the support being frictionally engaged with and retained on the bracket in overlying relation to its hook.

9. The tool of claim 8 wherein the longer leg of the support additionally serves as a seat providing support for the overlying siding strip.

* * * * *